US005276598A

United States Patent [19]

Hedenström et al.

[11] Patent Number: 5,276,598

[45] Date of Patent: Jan. 4, 1994

[54] DISPLAY UNIT AND LIGHT BOX THEREFOR

[75] Inventors: Curt U. Hedenström, Lomma; Bengt J. Arman, Landskrona, both of Sweden

[73] Assignee: Interfax AB, Malmo, Sweden

[21] Appl. No.: 846,660

[22] Filed: Mar. 4, 1992

[30] Foreign Application Priority Data

May 13, 1991 [SE] Sweden ..... 9101441

[51] Int. Cl.[5] ..... F21V 21/34

[52] U.S. Cl. ..... 362/238; 362/249; 362/226; 362/812; 40/573; 40/605

[58] Field of Search ..... 362/219, 227, 236, 237, 362/238, 249, 812, 226, 801, 250; 40/564, 573, 605, 442

[56] References Cited

U.S. PATENT DOCUMENTS 3,805,049 4/1974 Frank et al. ..... 40/573
4,006,546 2/1977 Anderson et al. ..... 40/573
4,275,520 6/1981 Appleton et al. ..... 40/605
4,602,448 7/1986 Grove ..... 362/219
4,707,766 11/1987 Bertozzi ..... 362/238
4,785,565 11/1988 Kuffner ..... 40/605
5,159,772 11/1992 Akaley ..... 40/605

FOREIGN PATENT DOCUMENTS 0374561 6/1990 European Pat. Off. .
2580108 10/1986 France .

*Primary Examiner*—Richard R. Cole
*Attorney, Agent, or Firm*—Luedeka, Hodges, Neely & Graham

[57] ABSTRACT

A display unit is formed of a number of individual light boxes which are electrically and mechanically interconnected in one or more rows. Each light box comprises complementary mounting and hook-on strips at two opposite sides for detachable interconnection of the light boxes in juxtaposed rows. Complementary electric connecting means are each arranged at one end of each light box for electrically and mechanically interconnecting light boxes in the same row. Current is supplied to the light boxes from one end of each row of light boxes by means of a conductor rail. To provide a play of lights, the lamp fitting of each light box has a control circuit which is designed as a receiver and whose turning on and off of the lamp fitting is controlled by a transmitter in the power supply circuit of the display unit.

8 Claims, 3 Drawing Sheets

DISPLAY UNIT AND LIGHT BOX THEREFOR

BACKGROUND OF THE INVENTION

For, inter alia, advertising purposes use is made of so-called display units comprising at least one translucent wall surface for supporting a large-size transparency film, and lamp fittings which are mounted internally and connectible to a current source. It also constitutes prior art to form such display units by mechanically and electrically interconnecting a number of light boxes, each having at least one translucent wall surface for supporting a large-size transparency film and each having at least one lamp fitting which can be turned on. Prior-art display units of the last-mentioned type are designed in a manner which requires a considerable expert knowledge and an electrician for mounting and connecting operations. As a result, such display units have not become so widely spread and used as they deserve.

SUMMARY OF THE INVENTION

One object of the present invention is to provide a display unit of the last-mentioned type and of such a design that it can readily be mounted by the individual user, without necessitating an electrician.

A further object is to provide a light box which is intended to be included in such a display unit.

According to the invention, these and other objects are achieved in that the display unit and the separate light box in the display unit are designed as recited in claims 1 and 5, respectively. The subclaims define preferred embodiments of the invention.

A display unit according to the invention thus comprises a number of separate light boxes which are electrically and mechanically interconnected in one or more rows. Each light box is provided with complementary mounting and hook-on strips at two opposite edges for detachable interconnection of light boxes in juxtaposed rows. Complementary electric connecting means are each arranged at one end of each light box for electric interconnection of light boxes in the same row. These electric connecting means preferably serve also to mechanically interconnect light boxes in one and the same row. Current is supplied to the light boxes from one end of each row by means of a conductor rail. To provide a play of lights, the lamp fitting of each light box can have a control circuit which is designed as a receiver and whose turning on and off of the lamp fitting is controlled by a transmitter in the power supply circuit of the display unit.

BRIEF DESCRIPTION OF THE DRAWINGS

The invention will now be described in more detail with reference to the accompanying drawings which illustrate an embodiment of a display unit and a light box, respectively, according to the present invention.

DESCRIPTION OF THE PREFERRED EMBODIMENTS

Figure 1:
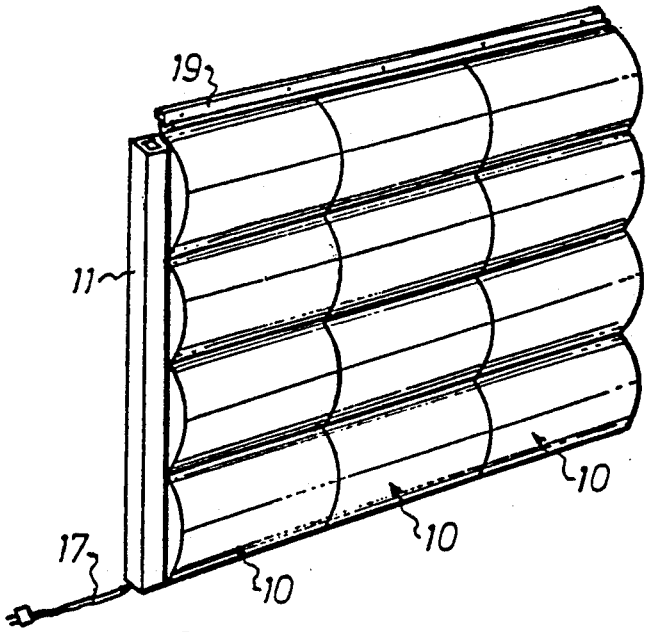
FIG. 1 is a perspective view of an embodiment of a display unit according to the invention.

FIG. 1 is a perspective view of a display unit which is designed according to the invention and in this case comprises twelve separate light boxes 10 which are positioned in threes in four superposed rows. Current is supplied to the display unit by means of a conductor rail 11 positioned at one end of the display unit.

Figure 5:
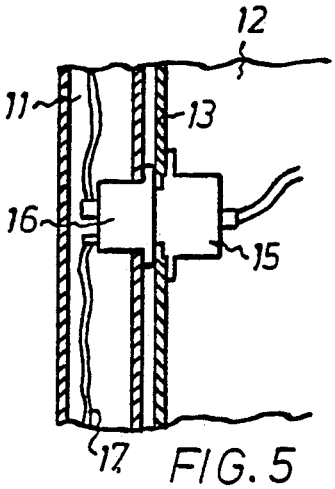
FIG. 5 shows on a larger scale the principles of supplying power to the light boxes of the display unit, while utilising a conductor rail.

In the embodiment shown, use is made of light boxes having a frame bent into U-shape with a side wall 12 and end walls 13. A lamp fitting 14 is mounted in the frame 12, 13. In this case, the lamp fitting comprises two fluorescent tubes. Current is supplied by means of an electric connecting means 15 which is positioned at one end wall 13 and projects therefrom as a plug. At the other end of the light box 10 there is a complementary connecting means 16 which is designed as a sleeve means whose outer surface is approximately aligned with the outside of the end wall 13. The conductor rail 11 also comprises connecting means 16 which are designed as sleeve means and are mounted in the rail with a spacing corresponding to the spacing between adjoining rows of light boxes 10. As shown in FIG. 5, these connecting means 16 are connected to an electric wire 17.

Figure 2:
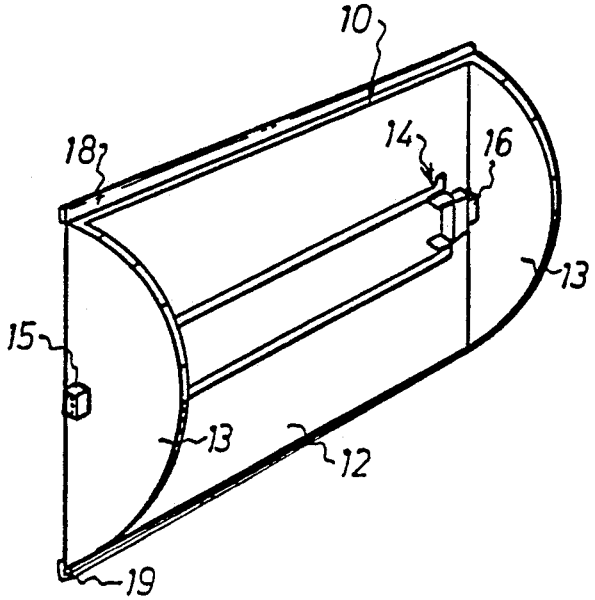
FIG. 2 illustrates parts of a light box which is included in the display unit according to FIG. 1 and which is shown in a partly dismounted state.
Figure 4:
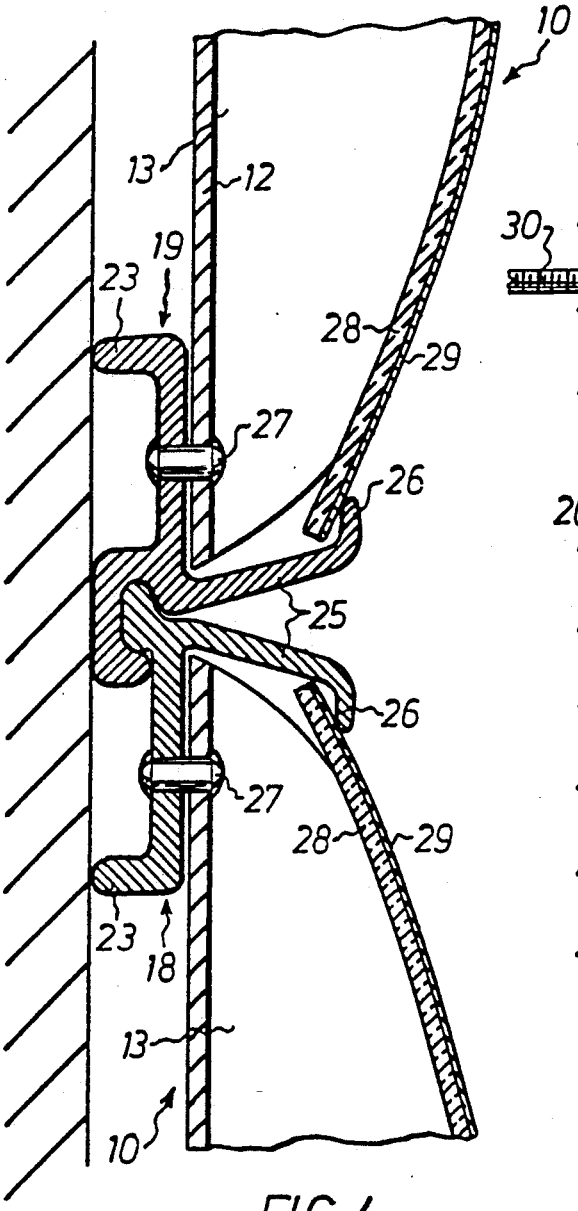
FIG. 4 shows parts of two light boxes included in the display unit, in an interconnected state.
Figure 3:
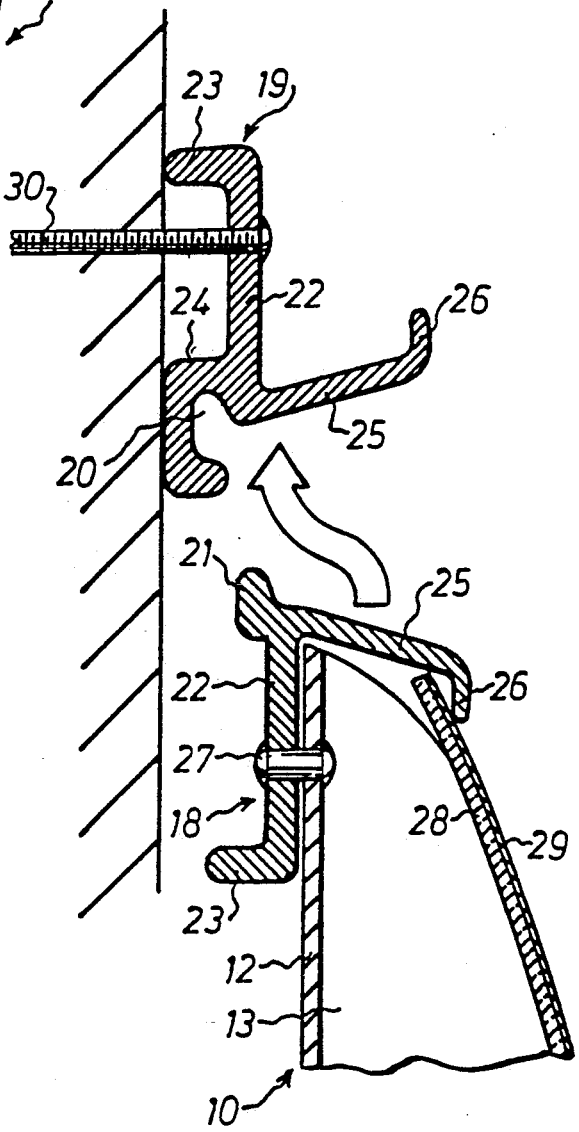
FIG. 3 is an enlarged view of mounting and hook-on strips included in the display unit and illustrates the principle of mounting the different light boxes of the display unit.

As shown in FIGS. 2–4, each light box 10 has complementarily designed mounting and hook-on strips 18, 19 at opposite sides. The mounting strip 19 is also used as a suspension strip for the display unit.

The complementary mounting and hook-on strips 18, 19 are designed to allow displacement of the light boxes 10 relative to each other in the longitudinal direction of the strips. To this end, the mounting strip 19 is formed with an undercut groove 20, and the hook-on strip 18 with a hook-shaped projection 21. The projection 21 is of such a shape that, after pivoting the hook-on strip 18 outwards to a mounting position, the projection can be inserted in the undercut groove 20 and, when pivoting the hook-on strip back to an operating position, the projection is engaged in a form-fitting manner with the undercut groove 20, while maintaining a longitudinal movability of the strips 18, 19 relative to one another. Each strip has an engaging portion 22 with which the wall surface 12 of the frame engages. At the free end of the engaging portion 22 there is formed a supporting flange 23. The groove 20 of the mounting strip 19 is formed in another longitudinal supporting flange 24.

The mounting and hook-on strips 18, 19 each have a flange 25 which is directed obliquely outwards. This flange terminates in an outer hook-like projection 26. The flanges 25 which are directed obliquely outwards make such an angle with the engaging portion 22 that the hook 21 is in its mounting position and can be inserted in the undercut groove, when the flanges 25 of the mounting and hook-on strips abut against one another.

FIGS. 3 and 4 also illustrate how the light box as such is designed. The strips 18, 19 thus are attached to the frame 12, 13 by means of e.g. blind rivets 27. The end walls 13 are designed to leave a gap between their outer edge and the hooks 26, thereby permitting insertion of a translucent panel 28 which suitably is a milk glass panel and forms the external wall of the light box. Moreover, the design is such that the translucent wall panel 28 is suitably formed of a tough translucent plastic material and can be inwardly bent a short distance to permit insertion of a large-size transparency film 29 into the gap. Since the panel 28 is curved, it will clamp the large-size transparency film 29 against the hook 26 by its resilience.

As shown in FIG. 3, use is made of a separate mounting strip 19 as a mounting for the upper light box 10. This strip 19 can be attached in some suitable manner to a surface, e.g. by means of screws 30.

In the embodiment illustrated, the light box 10 is shown hanging on a wall. The light box can also be designed to be hanging freely and can even be designed with opposite translucent wall surfaces 28 for mounting a large-size transparency film 29 on both sides of the light box.

Figure 6:
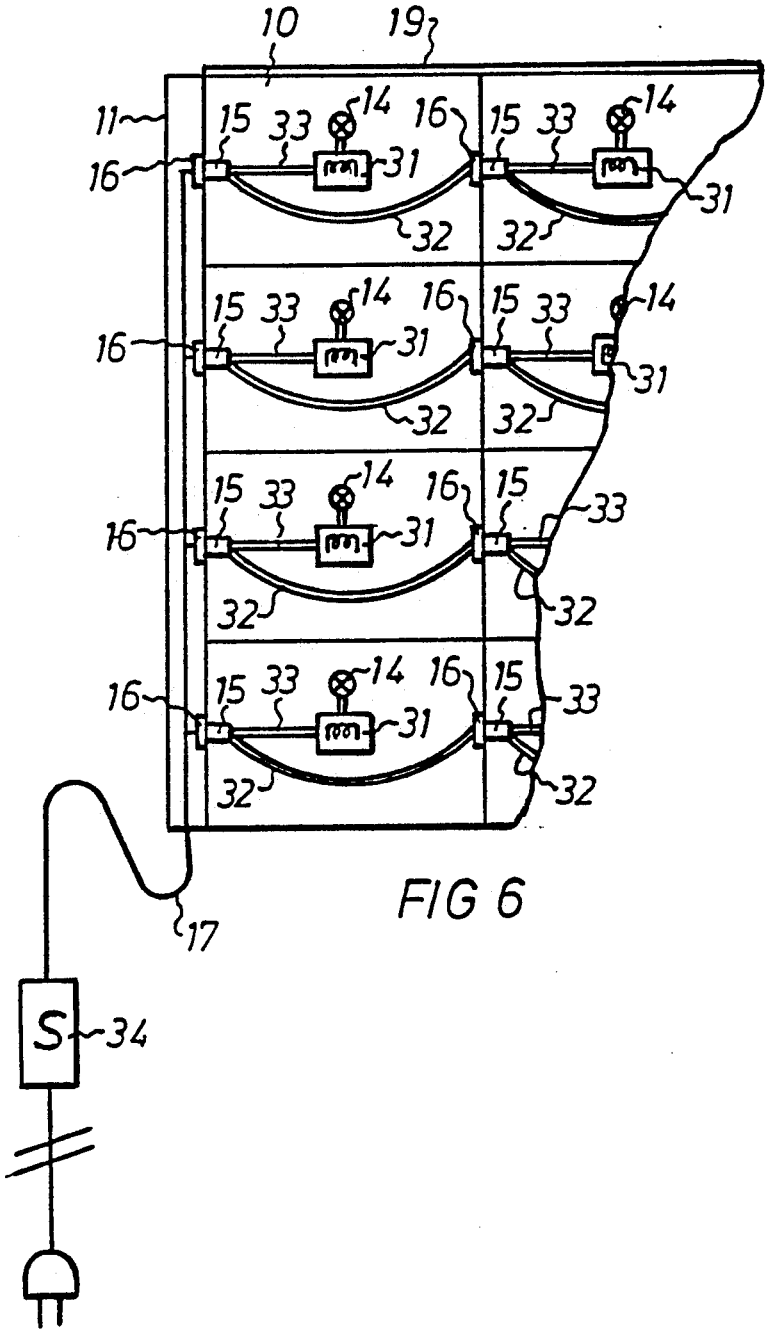
FIG. 6 shows a preferred embodiment of a wiring diagram for a display unit according to the invention.

FIG. 6 illustrates a preferred wiring diagram for a display unit according to the invention. In this embodiment, each light box 10 has been provided with a control circuit 31 which is designed as a receiver and controls the turning on and off of the lamp fitting 14.

The connecting means 15 arranged on each light box and designed as a plug is by means of a wire 32 directly connected to the connecting means 16 which is designed as a sleeve means and positioned at the other end of the light box. Moreover, there is arranged a wire 33 extending from the connecting means 15 to the control circuit 31 and the lamp fitting 14.

For turning on and off individual light boxes or groups of light boxes there is also provided a transmitter 34 which is inserted in the wire 17 extending from the current source of the display unit.

In the embodiment shown, the light boxes have been placed in four superjacent rows. Also other arrangements are feasible. Thus, all light boxes can be placed in one row or, for example, two light boxes can be placed in each row while using e.g. six or more superjacent rows. It is also possible to arrange all light boxes above each other.

For mounting the display unit according to the invention, merely the upper mounting strip 19 needs to be attached to a wall or the like. Subsequently, the left upper light box 10 can be hooked into the strip 19. Then the next light box in the same row is hooked into the strip 19 and, after this box has been pivoted to its downwardly directed position of use, the box is moved in the longitudinal direction of the strip so that the plug means 15 can be inserted in the sleeve means 16 in the light box which is already mounted. This sequence of mounting is then used for all the light boxes in the same row. After that, the light boxes in the subjacent row are mounted correspondingly. Finally, the conductor rail 11 is mounted on the light boxes by insertion of the plug means 15 of the light boxes into the sleeve means 16 of the conductor rail.

As is apparent from that stated above, the invention provides a display unit which allows high flexibility and is easily mounted and dismounted. The user can himself select the width and height of the display unit according to given modular measures. The individual light boxes can be designed as modules which are e.g. 50 cm high and 70 cm wide, or 70 cm high and 100 cm wide. Before mounting, the mounting strip 19 is cut or lengthened and is screwed in position on a level with the upper edge of the display unit to be provided. In the embodiment shown, the light boxes are mounted from the left to the right, the upper strip of each light box being inserted into the mounting strip by a simple hook-on function (FIG. 3). The light boxes are pushed together and are electrically connected via the plug means 15 projecting to the left and the corresponding sleeve means 16 of the adjoining light box. The connecting means 15, 16 now also function as locking means and hold the light boxes of the display unit together.

The remaining rows of boxes are mounted on the row which has now been hung, while using the strip 19 of the already mounted light boxes as a mounting strip.

In the embodiment illustrated, the conductor rail 11 is connected to the boxes of the display unit which are mounted at the extreme left. The design can be such as to allow twenty-four boxes to be connected to a 120 V outlet. If a still larger display unit is desired, additional modules must be connected to another outlet.

If desired, each display unit can be connected to a light play unit 34 which can be programmed as desired. The light play unit or transmitter 34 can be designed with a base program, but can be variable by the changing of program chips. For turning on and off the individual light boxes, the different receivers 31 in the light boxes have been designed in a prior-art manner with identification circuits of their own, which are activated by the transmitter or the light play unit 34.

What we claim and desire to secure by Letters Patent is:

1. Display unit of the type having at least two mechanically and electrically interconnected light boxes with lamp fittings which can be turned on, translucent wall surfaces for supporting a large-size transparency film each light box comprising complementary electric connecting means each arranged at one end of the light box, and interengageable mounting and hook-on strips which extend longitudinally along opposite side edges of each of the light boxes for interconnecting light boxes in juxtaposed rows, the mounting and hook-on strips being configured so as to allow interconnection of said light boxes in a direction which is substantially perpendicular to the longitudinal direction of said strips and wherein the interconnection of the mounting strip on one light box with the hook-on strip of the light box in the adjacent row providing a sliding interconnection which permits movement of the light boxes relative to each other in the longitudinal direction of said strips for engaging and disengaging complementary electric connecting means of adjoining light boxes in the same row.

2. Display unit as claimed in claim 1, wherein said mounting strip has an undercut groove, and said hook-on strip has a hook-shaped projection of such a shape that, after pivoting the hook-on strip outwards to a mounting position, the projection can be inserted in the undercut groove, and that, when pivoting the hook-on strip back to an operating position, the projection is engaged in a form-fitting manner with the undercut groove, while maintaining a longitudinal movability of the strips relative to one another.

3. Display unit as claimed in claim 1 or claim 2, wherein it comprises a conductor rail with electric connecting means which are arranged to engage the corresponding complementary connecting means in the light boxes in juxtaposed rows.

4. Display unit as claimed in claim 1 or 2 wherein each light box includes a control circuit designed as a receiver and adapted to turn on and off said lamp fitting of individual light boxes according to a predetermined program, in response to control signals supplied by a transmitter.

5. Display unit as claimed in claim 1 or 2 wherein the mounting strips and hook-on strips are oriented in a generally horizontal plane.

6. Light box for a display unit, having at least one translucent well surface for supporting a large-size transparency film and having a lamp fitting which can be turned on, wherein said light box comprises complementary electric connecting means each arranged at one end of the light box, and interengageable mounting and hook-on strips which are adapted to interconnect light boxes in juxtaposed rows and which extend longitudinally along opposite sides of the light box, the mounting and hoop-on strips being configured so as to allow interconnection of said light boxes in a direction which is substantially perpendicular to the longitudinal direction of said strips and wherein the interconnection of the mounting strip on one light box with the hook-on strip of a light box in an adjoining row provides a sliding interconnection from which permits movement of the light boxes relative to each other in the longitudinal direction of said strips for engaging and disengaging complementary electric connection means of adjoining light boxes in the sane row.

7. Light box as claimed in claim 6, wherein the mounting strip has an undercut groove, and said hook-on strip has a hook-shaped projection of such a shape that, after pivoting the hook-on strip outwards to a mounting position, the projection can be inserted in the undercut groove of an adjoining light box or mounting strip, and that, when pivoting the hook-on strip back to an operating position, the projection is engaged in a form-fitting manner with the undercut groove, while maintaining a longitudinal movability of the strips relative to one another.

8. Light box as claimed in claim 6 or 7, wherein it includes a control circuit designed as a receiver and adapted to turn on and off the lamp fitting of the light box in response to control signals supplied by a transmitter which is adapted to turn on and off the light box according to a predetermined program.

* * * * *